US008416099B2

(12) United States Patent
Bailey et al.

(10) Patent No.: US 8,416,099 B2
(45) Date of Patent: Apr. 9, 2013

(54) DYNAMIC ENVIRONMENTAL INFORMATION TRANSMISSION

(75) Inventors: Louis J. Bailey, Kent, WA (US); Ryan D. Hale, Kent, WA (US)

(73) Assignee: The Boeing Company, Chicago, IL (US)

( * ) Notice: Subject to any disclaimer, the term of this patent is extended or adjusted under 35 U.S.C. 154(b) by 89 days.

(21) Appl. No.: 12/547,809

(22) Filed: Aug. 26, 2009

(65) Prior Publication Data

US 2011/0050458 A1 Mar. 3, 2011

(51) Int. Cl.
*G08G 1/00* (2006.01)

(52) U.S. Cl. ..... 340/901; 340/506; 340/517; 340/521; 340/539.22; 340/3.1; 340/949; 340/968; 701/14; 702/3

(58) Field of Classification Search ..... 340/506, 340/517, 521, 539.22, 3.1, 949, 968, 901; 701/14, 3, 201, 211; 702/3
See application file for complete search history.

(56) References Cited

U.S. PATENT DOCUMENTS

| | | | | |
|---|---|---|---|---|
| 5,999,882 | A | 12/1999 | Simpson et al. | |
| 6,031,455 | A * | 2/2000 | Grube et al. | 340/539.26 |
| 6,501,392 | B2 | 12/2002 | Gremmert et al. | |
| 6,608,559 | B1 * | 8/2003 | Lemelson et al. | 340/539.13 |
| 6,744,382 | B1 | 6/2004 | Lapis et al. | |
| 6,816,780 | B2 * | 11/2004 | Naimer et al. | 701/206 |
| 6,828,922 | B1 * | 12/2004 | Gremmert et al. | 340/949 |
| 6,937,937 | B1 | 8/2005 | Manfred et al. | |
| 7,181,346 | B1 | 2/2007 | Kleist et al. | |
| 7,269,568 | B2 | 9/2007 | Stiles et al. | |
| 7,541,971 | B1 | 6/2009 | Woodell et al. | |
| 7,633,428 | B1 | 12/2009 | McCusker et al. | |
| 7,945,355 | B2 | 5/2011 | Akalinli et al. | |
| 7,966,122 | B2 | 6/2011 | Flynn et al. | |
| 8,085,182 | B2 | 12/2011 | Kauffman | |
| 2003/0130894 | A1 * | 7/2003 | Huettner et al. | 705/14 |
| 2004/0111192 | A1 * | 6/2004 | Naimer et al. | 701/9 |
| 2005/0086088 | A1 * | 4/2005 | Stiles et al. | 705/5 |
| 2005/0182675 | A1 * | 8/2005 | Huettner | 705/14 |
| 2005/0187741 | A1 | 8/2005 | Gilbert | |
| 2006/0259234 | A1 | 11/2006 | Flynn et al. | |
| 2007/0179703 | A1 | 8/2007 | Soussiel et al. | |
| 2009/0012663 | A1 | 1/2009 | Mead et al. | |
| 2010/0049382 | A1 | 2/2010 | Akalinli et al. | |
| 2010/0152931 | A1 | 6/2010 | Lacombe et al. | |
| 2011/0054718 | A1 | 3/2011 | Bailey | |

FOREIGN PATENT DOCUMENTS

| | | | |
|---|---|---|---|
| EP | 2290636 | A1 | 2/2011 |
| WO | 2005079179 | A1 | 9/2005 |

OTHER PUBLICATIONS

U.S. Appl. No. 12/547,821, filed Aug. 26, 2009, Bailey.
USPTO office action for U.S. Appl. No. 12/547,821, filed Dec. 8, 2010.
Gill et al., "Wind Nowcasting to Support Continuous Descent Approaches", UK Met office, Exeter, UK, pp. 1-8, retrieved Jul. 6, 2009 from http://ams.confex.com/ams/pdfpapers/131776.pdf.
U.S. Appl. No. 12/490,290, filed Jun. 23, 2009, Bailey et al.

(Continued)

*Primary Examiner* — Daryl Pope
(74) *Attorney, Agent, or Firm* — Yee & Associates, P.C.

(57) ABSTRACT

The different advantageous embodiments provide a system comprising a dynamic transmission process and a processor unit. The processor unit is configured to run the dynamic transmission process. The dynamic transmission process is configured to receive environmental information. The dynamic transmission process determines whether to send the environmental information to a subscriber.

23 Claims, 7 Drawing Sheets

OTHER PUBLICATIONS
International Search Report for Application No.: EP10173909 dated Dec. 1, 2010.
USPTO Final Office Action dated Aug. 5, 2011 for U.S. Appl. No. 12/547,821.
Final office action dated May 24, 2012 regarding U.S. Appl. No. 13/448,222, 11 pages.

* cited by examiner

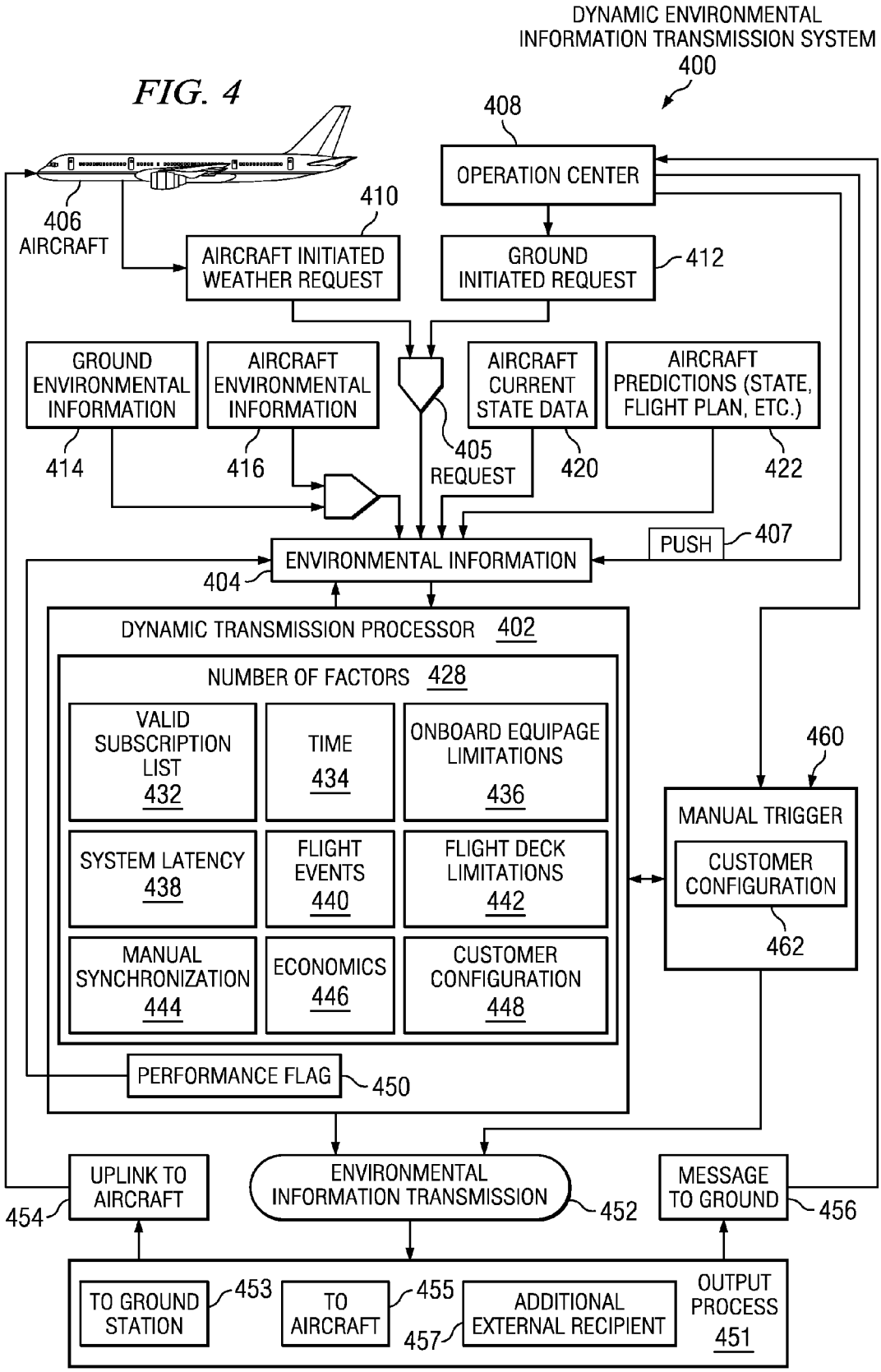
FIG. 4
DYNAMIC ENVIRONMENTAL INFORMATION TRANSMISSION SYSTEM
400
408
OPERATION CENTER
406
AIRCRAFT
410
AIRCRAFT INITIATED WEATHER REQUEST
GROUND INITIATED REQUEST
412
GROUND ENVIRONMENTAL INFORMATION
AIRCRAFT ENVIRONMENTAL INFORMATION
AIRCRAFT CURRENT STATE DATA
AIRCRAFT PREDICTIONS (STATE, FLIGHT PLAN, ETC.)
414
416
405
REQUEST
420
422
PUSH
407
ENVIRONMENTAL INFORMATION
404
DYNAMIC TRANSMISSION PROCESSOR 402
NUMBER OF FACTORS 428
VALID SUBSCRIPTION LIST 432
TIME 434
ONBOARD EQUIPAGE LIMITATIONS 436
SYSTEM LATENCY 438
FLIGHT EVENTS 440
FLIGHT DECK LIMITATIONS 442
MANUAL SYNCHRONIZATION 444
ECONOMICS 446
CUSTOMER CONFIGURATION 448
460
MANUAL TRIGGER
CUSTOMER CONFIGURATION
462
PERFORMANCE FLAG
450
UPLINK TO AIRCRAFT
454
ENVIRONMENTAL INFORMATION TRANSMISSION
452
MESSAGE TO GROUND
456
TO GROUND STATION
453
TO AIRCRAFT
455
ADDITIONAL EXTERNAL RECIPIENT
457
OUTPUT PROCESS 451

DYNAMIC ENVIRONMENTAL INFORMATION TRANSMISSION

CROSS REFERENCE TO RELATED APPLICATIONS

This application is related to commonly assigned and co-pending U.S. patent application Ser. No. 12/547,821 entitled "Dynamic Weather Selection", which is hereby incorporated by reference.

BACKGROUND INFORMATION

1. Field

The present disclosure relates generally to aircraft and in particular to a method and apparatus for providing environmental information to a subscriber. Still more particularly, the present disclosure relates to a method and apparatus for dynamically transmitting environmental information to a subscriber.

2. Background

Environmental information is used both during the planning and execution of flight operations. Planning flight operations results in the creation of flight plans. Flight plans are used to document basic information such as departure and arrival points, estimated time en route, various waypoints the aircraft must traverse en route, information pertaining to those waypoints, such as altitude and speed, and information relating to legs of the flight between those waypoints. This type of flight plan may be used to construct a flight trajectory including the various legs of the flight, which are connected to the various waypoints along the route.

Environmental information for the route between the departure and arrival points, including information about forecasted weather for the various waypoints along the route, may affect a flight trajectory. For example, if incorrect weather is forecasted for a particular waypoint along the route of the flight plan, certain predictions for the flight trajectory may become inaccurate, such as speed, fuel consumption, and time en route.

In current systems, the transmission of environmental information to an aircraft, for example, may be done at regulated intervals or upon a manual request, if done at all. The timing of the transmission is independent of any consideration of the pertinence of the information or the economic benefit of sending the transmission at that time. As a result, the environmental information may be inaccurate or dated at the time of transmission, which can result in inefficiencies for flight operations, such as an increase in fuel consumption and emissions or delay in flight time, for example.

Therefore, it would be advantageous to have a method and apparatus that overcomes one or more of the issues described above as well as possibly other issues.

SUMMARY

The different advantageous embodiments provide a system comprising a dynamic transmission process and a processor unit. The processor unit is configured to run the dynamic transmission process. The dynamic transmission process is configured to receive environmental information. The dynamic transmission process determines whether to send the environmental information to a subscriber.

The different advantageous embodiments further provide a method for transmitting environmental information. Environmental information is identified for a number of locations along a flight trajectory using a processor unit. A determination is made as to whether to send an environmental information transmission based on a number of factors using the processor unit.

The different advantageous embodiments further provide a method for generating an environmental information transmission. A recipient is identified for the environmental information transmission using a processor unit. The environmental information transmission is formatted based on the recipient identified using the processor unit.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

FIG. 4 is an illustration of a dynamic environmental information transmission system in accordance with an advantageous embodiment;

DETAILED DESCRIPTION

Figure 1:
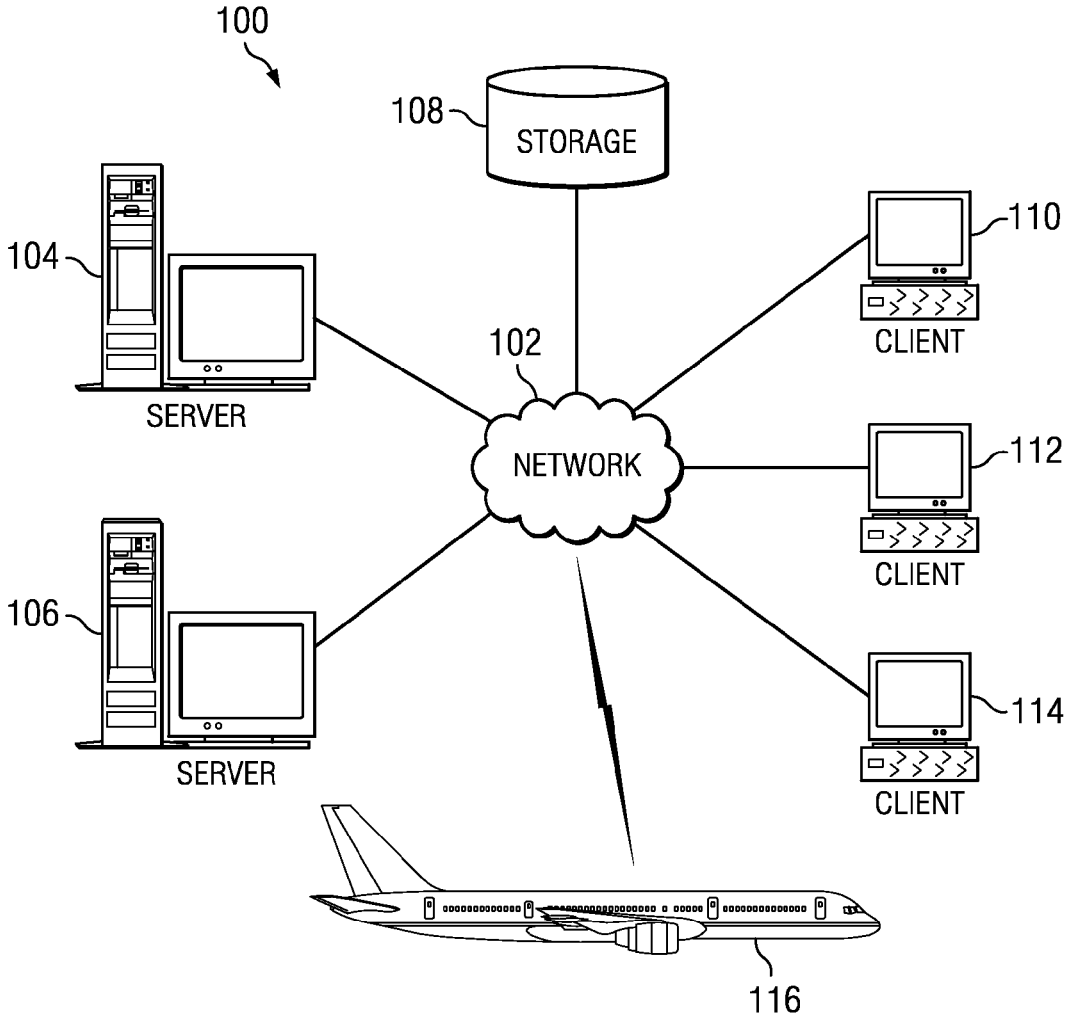
FIG. 1 is a pictorial representation of a network of data processing systems in which the advantageous embodiments of the present invention may be implemented.
Figure 2:
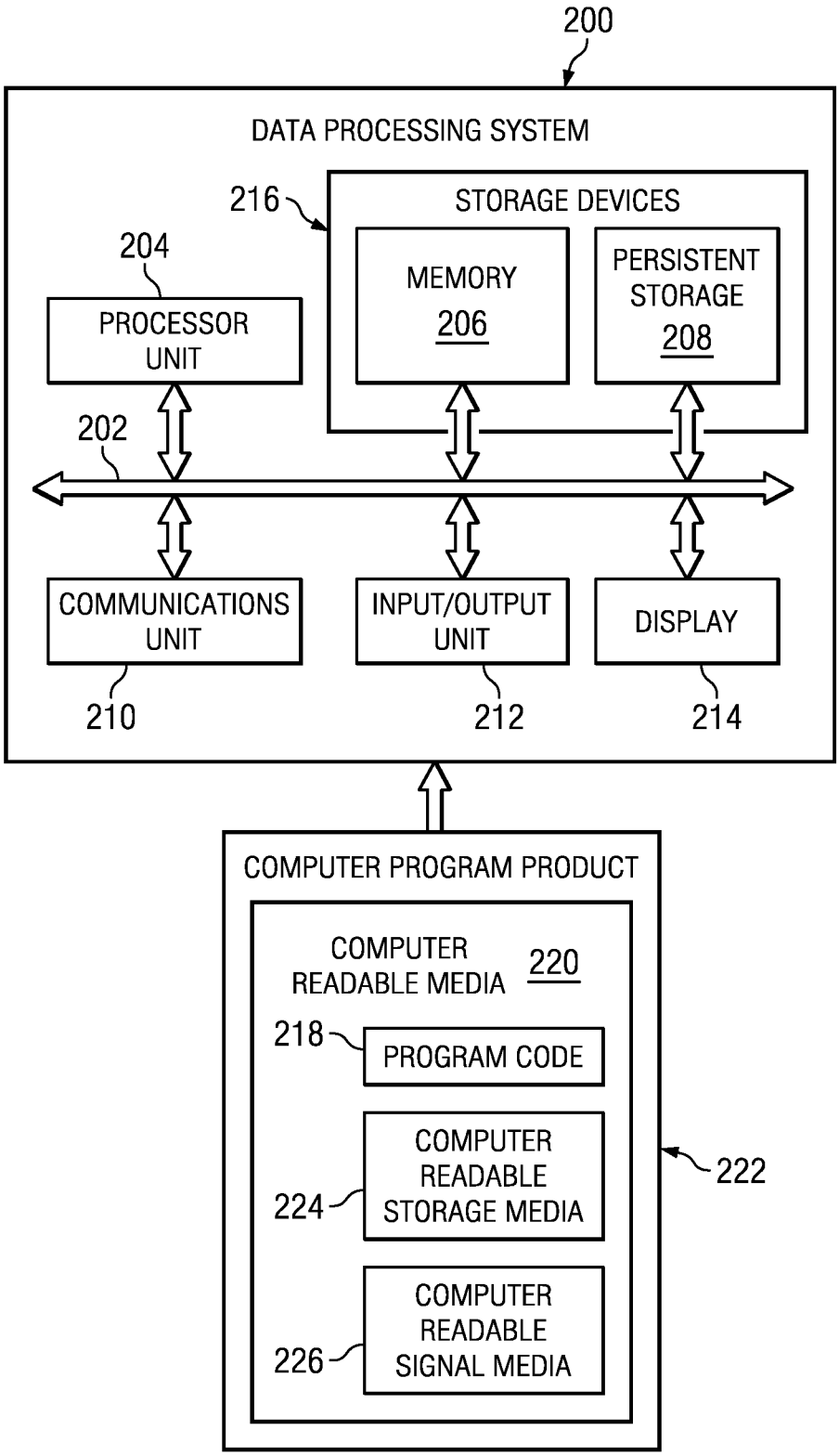
FIG. 2 is an illustration of a data processing system in accordance with an advantageous embodiment.

With reference now to the figures and in particular with reference to FIGS. 1-2, exemplary diagrams of data processing environments are provided in which the advantageous embodiments of the present invention may be implemented. It should be appreciated that FIGS. 1-2 are only exemplary and are not intended to assert or imply any limitation with regard to the environments in which different embodiments may be implemented. Many modifications to the depicted environments may be made.

With reference now to the figures, FIG. 1 depicts a pictorial representation of a network of data processing systems in which the advantageous embodiments of the present invention may be implemented. Network data processing system 100 is a network of computers in which embodiments may be implemented. Network data processing system 100 contains network 102, which is the medium used to provide communications links between various devices and computers connected together within network data processing system 100.

Network 102 may include connections, such as wire, wireless communication links, or fiber optic cables.

In the depicted example, server 104 and server 106 connect to network 102 along with storage unit 108. In addition, clients 110, 112, and 114 connect to network 102. These clients 110, 112, and 114 may be, for example, personal computers or network computers. In the depicted example, server 104 provides data, such as boot files, operating system images, and applications to clients 110, 112, and 114. Clients 110, 112, and 114 are clients to server 104 in this example. Aircraft 116 also is a client that may exchange information with clients 110, 112, and 114. Aircraft 116 also may exchange information with servers 104 and 106. Aircraft 116 may exchange data with different computers through a wireless communications link while in-flight or any other type of communications link while on the ground. In these examples, server 104, server 106, client 110, client 112, and client 114 may be computers. Network data processing system 100 may include additional servers, clients, and other devices not shown.

In the depicted example, network data processing system 100 is the Internet with network 102 representing a worldwide collection of networks and gateways that use the Transmission Control Protocol/Internet Protocol (TCP/IP) suite of protocols to communicate with one another. Of course, network data processing system 100 also may be implemented as a number of different types of networks, such as for example, an intranet, a local area network (LAN), or a wide area network (WAN). FIG. 1 is intended as an example, and not as an architectural limitation for different embodiments.

Turning now to FIG. 2, a block diagram of a data processing system is depicted in accordance with an advantageous embodiment. Data processing system 200 is an example of a data processing system that may be used to implement servers and clients, such as server 104 and client 110. Further, data processing system 200 is an example of a data processing system that may be found in aircraft 116 in FIG. 1.

In this illustrative example, data processing system 200 includes communications fabric 202, which provides communications between processor unit 204, memory 206, persistent storage 208, communications unit 210, input/output (I/O) unit 212, and display 214.

Processor unit 204 serves to execute instructions for software that may be loaded into memory 206. Processor unit 204 may be a set of one or more processors or may be a multiprocessor core, depending on the particular implementation. Further, processor unit 204 may be implemented using one or more heterogeneous processor systems in which a main processor is present with secondary processors on a single chip. As another illustrative example, processor unit 204 may be a symmetric multi-processor system containing multiple processors of the same type.

Memory 206 and persistent storage 208 are examples of storage devices 216. A storage device is any piece of hardware that is capable of storing information, such as, for example without limitation, data, program code in functional form, and/or other suitable information either on a temporary basis and/or a permanent basis. Memory 206, in these examples, may be, for example, a random access memory or any other suitable volatile or non-volatile storage device. Persistent storage 208 may take various forms depending on the particular implementation. For example, persistent storage 208 may contain one or more components or devices. For example, persistent storage 208 may be a hard drive, a flash memory, a rewritable optical disk, a rewritable magnetic tape, or some combination of the above. The media used by persistent storage 208 also may be removable. For example, a removable hard drive may be used for persistent storage 208.

Communications unit 210, in these examples, provides for communications with other data processing systems or devices. In these examples, communications unit 210 is a network interface card. Communications unit 210 may provide communications through the use of either or both physical and wireless communications links.

Input/output unit 212 allows for input and output of data with other devices that may be connected to data processing system 200. For example, input/output unit 212 may provide a connection for user input through a keyboard, a mouse, and/or some other suitable input device. Further, input/output unit 212 may send output to a printer. Display 214 provides a mechanism to display information to a user.

Instructions for the operating system, applications and/or programs may be located in storage devices 216, which are in communication with processor unit 204 through communications fabric 202. In these illustrative examples the instructions are in a functional form on persistent storage 208. These instructions may be loaded into memory 206 for execution by processor unit 204. The processes of the different embodiments may be performed by processor unit 204 using computer implemented instructions, which may be located in a memory, such as memory 206.

These instructions are referred to as program code, computer usable program code, or computer readable program code that may be read and executed by a processor in processor unit 204. The program code in the different embodiments may be embodied on different physical or tangible computer readable media, such as memory 206 or persistent storage 208.

Program code 218 is located in a functional form on computer readable media 220 that is selectively removable and may be loaded onto or transferred to data processing system 200 for execution by processor unit 204. Program code 218 and computer readable media 220 form computer program product 222 in these examples. In one example, computer readable media 220 may be in a tangible form, such as, for example, an optical or magnetic disc that is inserted or placed into a drive or other device that is part of persistent storage 208 for transfer onto a storage device, such as a hard drive that is part of persistent storage 208. In a tangible form, computer readable media 220 also may take the form of a persistent storage, such as a hard drive, a thumb drive, or a flash memory that is connected to data processing system 200. The tangible form of computer readable media 220 is also referred to as computer recordable storage media. In some instances, computer readable media 220 may not be removable.

Alternatively, program code 218 may be transferred to data processing system 200 from computer readable media 220 through a communications link to communications unit 210 and/or through a connection to input/output unit 212. The communications link and/or the connection may be physical or wireless in the illustrative examples. The computer readable media also may take the form of non-tangible media, such as communications links or wireless transmissions containing the program code.

In some illustrative embodiments, program code 218 may be downloaded over a network to persistent storage 208 from another device or data processing system for use within data processing system 200. For instance, program code stored in a computer readable storage medium in a server data processing system may be downloaded over a network from the server to data processing system 200. The data processing system providing program code 218 may be a server computer, a client computer, or some other device capable of storing and transmitting program code 218.

The different components illustrated for data processing system 200 are not meant to provide architectural limitations to the manner in which different embodiments may be implemented. The different illustrative embodiments may be implemented in a data processing system including components in addition to or in place of those illustrated for data processing system 200. Other components shown in FIG. 2 can be varied from the illustrative examples shown. The different embodiments may be implemented using any hardware device or system capable of executing program code. As one example, the data processing system may include organic components integrated with inorganic components and/or may be comprised entirely of organic components excluding a human being. For example, a storage device may be comprised of an organic semiconductor.

As another example, a storage device in data processing system 200 is any hardware apparatus that may store data. Memory 206, persistent storage 208 and computer readable media 220 are examples of storage devices in a tangible form.

In another example, a bus system may be used to implement communications fabric 202 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 206 or a cache such as found in an interface and memory controller hub that may be present in communications fabric 202.

The different advantageous embodiments recognize and take into account a number of different considerations. For example, the different advantageous embodiments recognize and take into account that currently used systems do not have the ability to automatically measure the added benefit of a possible environmental information transmission. Even when environmental information is transmitted, current methods increase inefficiencies in the flight trajectory calculations if the environmental information is out of date, not entered into a flight management computer, or provided at the wrong time. Additionally, current systems and methods do not consider the impact of environmental factors, flight phases, the type of environmental information, or aircraft events when choosing whether or not to send an environmental information transmission. Rather, current methods require a manual uplink and typically a manual request for an environmental information transmission.

The different advantageous embodiments further recognize and take into account the need for a comprehensive environmental information transmission process that can measure economic benefit to automatically determine the needed transmission time to accommodate the dynamic nature of aircraft flight. Economic benefit to aircraft operations can be measured in time saved, fuel saved, a reduction in noise, a reduction in emissions, crew or operator workload and/or any combination of the foregoing.

Thus, the different advantageous embodiments provide a system comprising a dynamic transmission process and a processor unit. The processor unit is configured to run the dynamic transmission process. The dynamic transmission process is configured to receive environmental information. The dynamic transmission process determines whether to send the environmental information to a subscriber.

The different advantageous embodiments further provide a method for transmitting environmental information. Environmental information is identified for a number of locations along a flight trajectory using a processor unit. A determination is made as to whether to send an environmental information transmission based on a number of factors using the processor unit.

The different advantageous embodiments further provide a method for generating an environmental information transmission. A recipient is identified for the environmental information transmission using a processor unit. The environmental information transmission is formatted based on the recipient identified using the processor unit.

Figure 3:
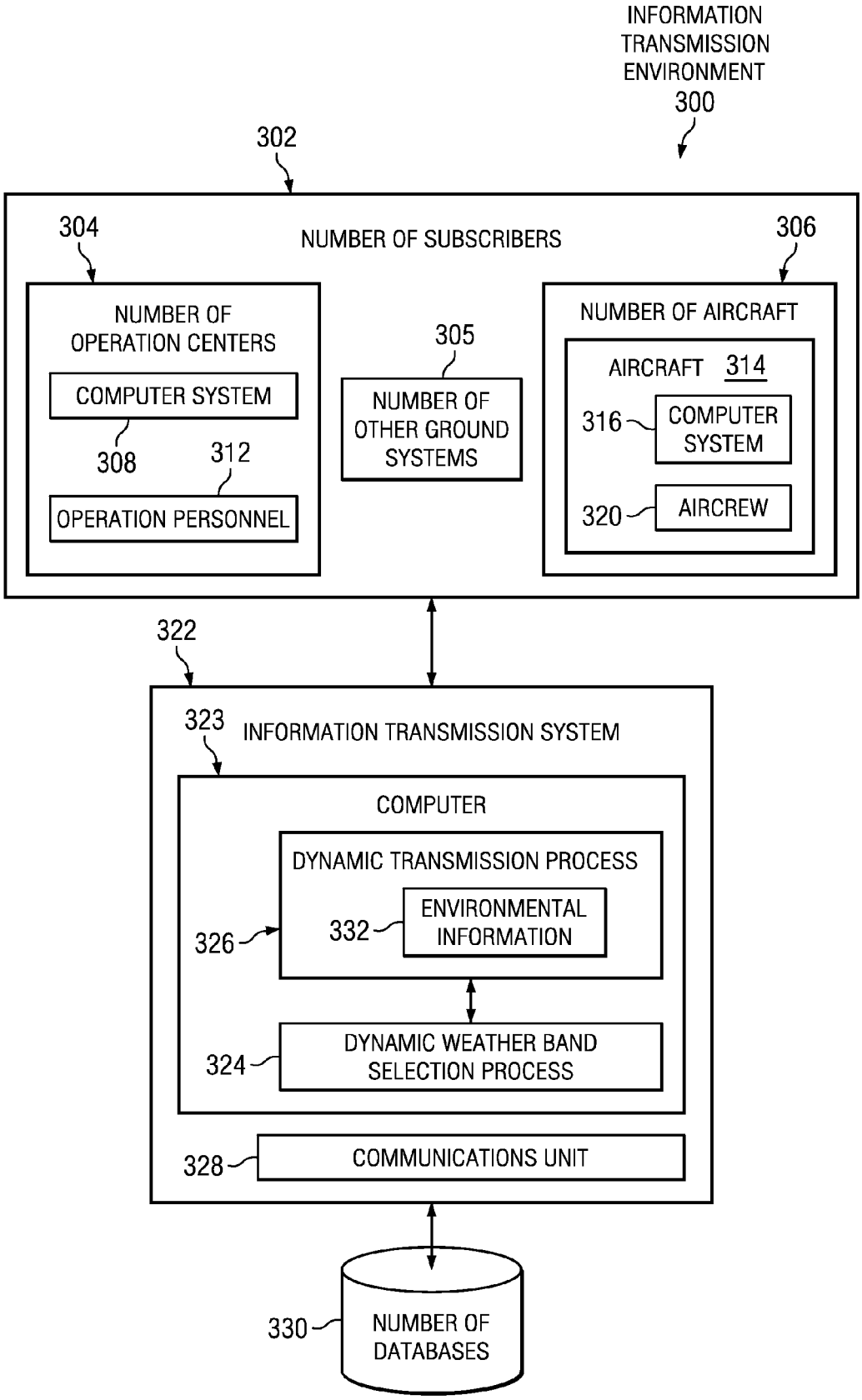
FIG. 3 is an illustration of a information transmission environment in accordance with an advantageous embodiment.

With reference now to FIG. 3, an illustration of an information transmission environment is depicted in accordance with an advantageous embodiment. Information transmission environment 300 may be an illustrative example of one implementation of a networked transmission environment, such as network 102 in FIG. 1.

Information transmission environment 300 includes number of subscribers 302. Number of subscribers 302 may include, for example, without limitation, number of operation centers 304, number of other ground systems 305, number of aircraft 306, and/or any other suitable subscriber. Number of operation centers 304 may include, without limitation, airline operation centers at various locations, and/or any other type of operation centers, for example.

Number of operation centers 304 includes computer system 308 and operation personnel 312. Computer system 308 may include a number of computers. As used herein, a number refers to one or more computers. The number of computers of computer system 308 may be networked in an environment such as network 102 in FIG. 1. Number of operation centers 304 may also include operation personnel 312

Number of aircraft 306 may be any type of aircraft including, without limitation, jet engine aircraft, twin engine aircraft, single engine aircraft, spacecraft, and/or any other suitable type of aircraft. Aircraft 314 may be an example of one implementation of number of aircraft 306. Aircraft 314 includes computer system 316 and aircrew 320. Computer system 316 may include a number of computers. The number of computers of computer system 316 may be networked in an environment such as network 102 in FIG. 1. Number of other ground systems 305 may include, without limitation, weather reporting stations, weather monitoring stations, and/or any other suitable ground system.

In one advantageous embodiment, information transmission system 322 is located in a remote location from number of operation centers 304, number of other ground systems 305, and number of aircraft 306. In this example, information transmission system 322 may be operated by a third party service. Information transmission system 322 includes computer 323 and communications unit 328. Information transmission system 322 uses communications unit 328 to interact with number of subscribers 302, such as number of operation centers 304, number of other ground systems 305, and number of aircraft 306. Information transmission system 322 may be implemented using one or more of data processing system 200.

Communications unit 328, in these examples, provides for communications with other data processing systems or devices. In these examples, communications unit 328 may be a network interface card. Communications unit 328 may provide communications through the use of either or both physical and wireless communications links. Communications unit 328 may be integrated with computer 323 and/or may be independent from and accessible to computer 323.

Computer 323 may include dynamic weather band selection process 324 and dynamic transmission process 326. Dynamic weather band selection process 324, dynamic transmission process 326, and/or communications unit 328 are configured to access number of databases 330. Number of databases 330 may include various databases with information such as, ground weather, aircraft weather, aircraft state data, aircraft predictions, aircraft model identification, flight plans, and/or any other suitable information. Dynamic transmission process 326 may receive environmental information 332 from a number of different sources. In one advantageous embodiment, environmental information 332 may be accessed using number of databases 330. In another advantageous embodiment, environmental information 332 may be received from number of operation centers 304, number of other ground systems 305, and/or number of aircraft 306. In an illustrative example, operation personnel 312 of number of operation centers 304 may send updated environmental information 332 to dynamic transmission process 326 of computer 323. In another illustrative example, aircrew 320 of aircraft 314 may send observed environmental information 332 to dynamic transmission process 326. In yet another illustrative example, environmental information 332 from number of other ground systems 305 may be transmitted to and/or retrieved by dynamic transmission process 326.

Dynamic transmission process 326 is configured to receive environmental information 332 from a number of different sources and determine whether and/or when to transmit the environmental information to number of subscribers 302. Dynamic transmission process 326 may analyze a number of factors in order to determine whether an environmental information transmission should be sent to a subscriber in number of subscribers 302. In an illustrative example, one factor that may be considered by dynamic transmission process 326 may be whether an environmental information transmission provides an economic benefit if transmitted during a specific time period. Dynamic transmission process 326 may also analyze a number of factors in order to determine when to send an environmental information transmission. In the illustrative example of an economic factor, dynamic transmission process 326 may consider the economic benefit of a transmission during a specific time period, if any, and select when to transmit the environmental information accordingly. When to transmit may include, without limitation, immediately, or at a future designation, for example.

Dynamic transmission process 326 may determine whether to send a transmission independently of a determination of when to send a transmission, and vice versa. The determination of whether to send a transmission and when to send a transmission may be made concurrently and independently by dynamic transmission process 326 using a number of factors. The number of factors may include, for example, without limitation, a valid subscription list, time, onboard equipage limitations, system latency, flight events, flight deck limitations, manual synchronization, economics, customer configuration, on/off settings, and/or any other suitable factor.

In an illustrative example, dynamic transmission process 326 may determine when to send a transmission based on a number of factors and output a value for when a transmission is to be sent. In one example, the determination of when to send a transmission may result in an output of "one hour prior to destination." In another example, the determination of when to send a transmission may result in an output of "when there is a total measured economic benefit of three hundred dollars if the transmission is sent."

The illustration of information transmission environment 300 in FIG. 3 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in one advantageous embodiment, information transmission system 322 may be distributed across or located in at least one of a remote location, number of operation centers 304, number of other ground systems 305, and/or number of aircraft 306. In another advantageous embodiment, information transmission system 322 may be implemented with dynamic transmission process 326 and without dynamic weather band selection process 324, receiving environmental information from number of subscribers 302 and/or number of databases 330 only. In yet another advantageous embodiment, information transmission system 322 may be integrated with an environmental information detection system, for example.

As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C or item B and item C.

Turning now to FIG. 4, an illustration of a dynamic environmental information transmission system is depicted in accordance with an advantageous embodiment. Dynamic environmental information transmission system 400 is an illustrative example of one implementation of information transmission system 322 in FIG. 3. Dynamic environmental information transmission system 400 may be implemented using a data processing system, such as data processing system 200 in FIG. 2.

Dynamic environmental information transmission system 400 includes dynamic transmission processor 402. Dynamic transmission processor 402 is configured to receive environmental information 404 and determine when to transmit environmental information 404. Environmental information 404 may be specific to a flight plan and/or a particular current and predicted flight trajectory, for example. The decision of whether and when to transmit the environmental information is made by dynamic transmission processor 402 based on, without limitation, the environmental information message type, aircraft type, on-board equipage, current and forecasted weather, flight plan, phase of flight, aircraft events, aircraft state data, and the computed trajectory for the flight plan.

Environmental information may include, but is not limited to, weather, temperature, pressure, humidity, turbulence, icing, wind speed, wind direction, wind vertical acceleration, thermal anti-icing for engine bleeds, temperature deviations from standard atmospheric temperatures, barometric pressure, and/or any other suitable environmental information. Different types of environmental information messages may be transmitted depending upon phase of flight and/or the state of a flight plan. Phase of flight may include, for example, without limitation, on-ground, climbing, cruising, descending, and/or any other suitable phase of flight. The state of a flight plan may include, for example, without limitation, active flight plan, inactive flight plan, alternate flight plan, and/or any other suitable state. Aircraft events may include, for example, without limitation, gear extension, gear retraction, flap extension, flap retraction, step climb points, step down points, and/or any other suitable aircraft event where there are changes in aircraft pitch, speed, and/or thrust.

Dynamic transmission processor 402 may continually evaluate environmental information 404 received in order to dynamically determine whether and when to transmit environmental information 404 to a subscriber, such as aircraft 406 and/or operation center 408, for example. Dynamic transmission processor 402 may also be triggered to evaluate environmental information 404 by request 405, push 407, or some other event to dynamically determine whether and when to send environmental information 404 to a number of subscribers. Request 405 may be initiated by either aircraft 406 through aircraft initiated weather request 410, operation center 408 through ground initiated request 412, or some other automatic event, such as push 407 from operation center 408, for example.

Request 405 may include a specific flight plan or flight trajectory used by dynamic transmission processor 402 to dynamically determine an economic benefit, if any, of an environmental information transmission in response to request 405, for example. As additional illustrative examples, the event triggering request 405 may be, for example, without limitation, receipt of updated environmental information, a change in a flight plan, or some other suitable event. Push 407 may be an automatic information push of a flight plan and/or environmental information to dynamic transmission processor 402 to calculate an economic benefit of an environmental information transmission before any request is made by an aircraft, for example.

Dynamic transmission processor 402 may receive environmental information 404 from a number of different sources, including, without limitation, a number of databases, such as ground environmental information 414, aircraft environmental information 416, aircraft current state data 420, and aircraft predictions 422. Ground environmental information 414, aircraft environmental information 416, aircraft current state data 420, and aircraft predictions 422 may be illustrative examples of one implementation of number of databases 330 in FIG. 3. Dynamic transmission processor 402 may also receive environmental information 404 directly from a number of aircraft and/or operation centers, such as aircraft 406 and operation center 408, for example. In another illustrative example, dynamic transmission processor 402 may receive environmental information 404 from a weather band processor, such as dynamic weather band selection process 324 in FIG. 3.

Ground environmental information 414 may include, without limitation, information collected from weather sources, such as, for example, without limitation, National Oceanic and Atmospheric Administration (NOAA). Ground environmental information 414 may also include information about weather local to a particular operation center, forecasted weather information for a number of locations, and/or any other suitable type of ground environmental information. Operation center 408 may be an illustrative example of one implementation of an operation center that sends environmental information to ground environmental information 414.

Aircraft environmental information 416 may include environmental information directly reported or derived from a number of aircraft, such as number of aircraft 306 in FIG. 3, for example. Aircraft 406 may be an illustrative example of one implementation of an aircraft that directly sends currently observed environmental information to aircraft environmental information 416. Aircraft environmental information 416 may include information such as, without limitation, weather, temperature, pressure, humidity, turbulence, icing, wind speed, wind direction, wind vertical acceleration, thermal anti-icing for engine bleeds, temperature deviations from standard atmospheric temperatures, barometric pressure, and/or any other suitable information pertaining to a number of different points for a particular flight path and/or trajectory.

Aircraft current state data 420 includes information pertaining to a number of aircraft, such as number of aircraft 306 in FIG. 3. Aircraft current state data 420 may include a number of unique identifiers for the number of aircraft, such as tail numbers for example. Aircraft current state data 420 may identify a particular aircraft and include current state information about that particular aircraft, such as, without limitation, on-ground, climbing, cruising, descending, altitude, heading, weight, center of gravity, speed, and/or any other suitable state data.

Aircraft predictions 422 may include a number of flight plans and associated predictions for the trajectory of an aircraft based on each of the number of trajectories associated with the number of flight plans. Aircraft predictions 422 includes aircraft state data predictions associated with a number of points in time based on predicted weather, flight plan, weight of aircraft, aircraft configuration, and/or any other suitable information.

Dynamic transmission processor 402 includes number of factors 428. Numbers of factors 428 are used by dynamic transmission processor 402 to determine whether and when to send environmental information transmission 452. Number of factors 428 may include, without limitation, valid subscription list 432, time 434, onboard equipage limitations 436, system latency 438, flight events 440, flight deck limitations 442, manual synchronization 444, economics 446, customer configuration 448, and/or any other suitable factor. In an illustrative example, dynamic transmission processor 402 may use valid subscription list 432 to determine whether or not to send environmental information transmission 452 based on whether or not request 405 and/or push 407 is received from a valid subscriber. In another illustrative example dynamic transmission processor 402 may use time 434 to determine when to send environmental information transmission 452 based on the amount of time to and/or from an event, such as aircraft touchdown for example. In the illustrative example of time 434, dynamic transmission processor 402 may determine that environmental information transmission 452 should be sent ten minutes prior to touchdown, or ten nautical miles prior to touchdown, for example. Dynamic transmission processor 402 uses number of factors 428 to determine both whether and when to send environmental information transmission 452. The determination of both whether and when to send environmental information transmission 452 may be made concurrently and independently by dynamic transmission processor 402.

Valid subscription list 432 may be one factor used by dynamic transmission processor 402 in determining whether or when environmental information transmission 404 should be transmitted. Valid subscription list 432 is used by dynamic transmission processor 402 to determine whether an aircraft, operation center, and/or other requestor is configured as a subscriber to dynamic transmission processor 402. If the requestor is not a subscriber, no transmission will be made regardless of any other factors.

Time 434 evaluates inputs such as, without limitation, distance, position, and direct calculations related to an aircraft in reference to a trajectory being considered. These calculations by time 434 directly influence the economic benefit for transmission of environmental information 404. Time 434 is used by dynamic transmission processor 402 to determine a time window for transmission of environmental information transmission 452. Time 434 may also be modified and/or configured using customer configuration 462 to customize the time window for transmission according to subscriber preferences.

Onboard equipage limitations 436 evaluates the limitations of a particular aircraft due to available onboard equipage. For example, the flight management computer on aircraft 406 may be unable to process specific types of environmental information in a transmission. In this example, the types of environmental information that aircraft 406 is unable to process would be unnecessary to a transmission, and may be eliminated from environmental information transmission 452 in order to mitigate confusion and/or added workload on the flight deck.

System latency 438 is used by dynamic transmission processor 402 to determine whether and when the economic benefit identified for a transmission will be lost due to system latency. System latency refers to a time delay between the initiation of the transmission of environmental information 404, and the moment the transmission begins or becomes detectable. System latency may occur as a result of, without limitation, flight deck limitations, onboard equipage limitations, end-to-end system processing, and/or any other suitable latency factor.

Flight events 440 is used by dynamic transmission processor 402 to evaluate a number of events that may occur to inhibit and/or trigger initial or additional environmental information transmissions for a subscriber. Events that may trigger transmission include, without limitation, weather forecast modification, flight plan change, and altitude change, for example. Events that may inhibit transmission include, without limitation, emergency events, and missed approach, for example. In an illustrative example, if aircraft 406 is climbing, the process may initiate transmission of environmental information transmission 452. However, in this example, if aircraft 406 experiences a missed approach, the automated process may inhibit transmission of environmental information transmission 452 due to the current workload on the flight deck to fly the missed approach.

Flight deck limitations 442 takes into account the affect of environmental information transmission 452 on the flight deck of an aircraft, such as aircraft 406. For example, economic benefit may be negated if a transmission would cause unnecessary distraction, confusion, or additional workload to the flight deck. Additionally, flight deck limitations 442 takes into account the amount of time a particular flight deck of a subscriber aircraft, such as aircraft 406, requires to process a transmission uplink, such as uplink to aircraft 454 for example. Flight deck processing time may include the time it takes to verify the environmental information provided by the transmission and enter the environmental information into the flight processor, for example. In an illustrative example, some flight decks may include a flight processor that allows for automatic entering of environmental information received, while other flight decks may include a flight processor that requires manual submission of the environmental information.

Manual synchronization 444 may bypass the automated environmental information transmission process based on customer configuration 462 of manual trigger 460, for example. A subscriber may customize transmission parameters, including when a transmission is sent. In an illustrative example, dynamic transmission processor 402 may also automatically sync with manual synchronization 444 to eliminate unnecessary automatic transmissions based on when manual transmissions are configured to be sent.

Economics 446 evaluates the operational and economic benefit of a potential environmental information transmission against the other factors in number of factors 428. Economics 446 allows dynamic transmission processor 402 to determine the economic benefit of environmental information transmission 452 in determining when, if ever, to transmit the environmental information. This determination of economic benefit may lead to increased airline efficiency and economy, reduced operating costs, optimized flight times, increased airspace capacity, increased predictability, and improved airline coordination, among other benefits.

Customer configuration 448 allows a subscriber to dynamically configure number of factors 428. A subscriber may use customer configuration 448 to override default settings of each of number of factors 428 and/or add additional factors to number of factors 428. A subscriber may also use customer configuration 448 to ignore any manual triggers, such as manual trigger 460, or to use a manual trigger to make a final determination on whether and/or when to send environmental information transmission 452 if new environmental information is available at a later time for transmission, for example. In an illustrative example, dynamic transmission processor 402 may also automatically sync customer configuration 448 with manual synchronization 444 to eliminate unnecessary automatic transmissions based on when manual trigger 460 is configured to be sent.

Performance flag 450 may be an additional process in dynamic transmission processor 402. Performance flag 450 may be used to initiate a calculation of a new weather information, environmental information transmission determination, flight trajectory, or other possible calculations.

Dynamic transmission processor 402 dynamically determines whether and/or when to send environmental information transmission 452 based on number of factors 428 and environmental information 404 received. Environmental information transmission 452 may include, for example, without limitation, a number of weather bands and/or any other environmental information. Environmental information transmission 452 is then sent to output process 451. Dynamic transmission processor 402 uses output process 451 to determine how and where environmental information transmission 452 should be sent. Output process 451 determines the recipient of environmental information transmission 452 and formats environmental information transmission 452 based on the recipient. Output process 451 may identify a number of data formats capable of being received by a particular recipient, such as aircraft 406 or operation center 408 for example. As used herein, a number of data formats refers to one or more data formats.

In one illustrative example, aircraft 406 may be able to receive environmental information transmission 452 in any combination of data formats. The data formats may be, for example, without limitation, freetext, standard aircraft communications addressing and reporting system (ACARS) messaging, and/or any other suitable data format. In another illustrative example, aircraft 406 may only be able to receive environmental information transmission 452 in one specific data format compatible with systems of aircraft 406. In still another illustrative example, environmental information transmission 452 may be sent in a specific data format preferred by operation center 408.

Output process 451 may also configure the contents of environmental information transmission 452 based on a determination made by dynamic transmission processor 402 using number of factors 428. In one illustrative example, dynamic transmission processor 402 may determine that the flight management computer on aircraft 406 is unable to process specific types of environmental information in a transmission. In this example, output process 451 may limit or restrict these specific types of environmental information from environmental information transmission 452.

Environmental information transmission 452 may be formatted for and sent to any and/or all of ground station 453, aircraft 455, or additional external recipient 457. Additional external recipient 457 may be, without limitation, an air navigation service provider or other qualified subscriber, for example. In one illustrative example, environmental information transmission 452 may be formatted for transmission to aircraft 455, and sent as weather uplink to aircraft 454. In another illustrative example, environmental information transmission 452 may be formatted for transmission to ground station 453, and sent as weather message to ground 456.

Environmental information transmission 452 may be sent as either or both uplink to aircraft 454 and message to ground 456. If dynamic transmission processor 402 determines that environmental information transmission 452 should not be sent, no transmission is sent unless manual trigger 460 overrides the automated process, and dynamic transmission processor 402 continues to evaluate environmental information 404 as it is received and/or obtained.

Alternatively, manual trigger 460 may be a trigger that may be initiated based on customer configuration 462. For example, manual trigger 460 may be triggered by a subscriber, such as operation center 408 for example, based on customer configuration 462 that subscriber operation center 408 modified using desired parameters.

For example, in one advantageous embodiment, a manual request may be initiated from any qualified subscriber of the environmental information transmission system. In another advantageous embodiment, manual and automatic triggers can be used to reinitialize the process given a new set of conditions. An example of this may be flight plan modifications. In this example, one weather solution may have been computed according to the initial flight path of an aircraft, but the aircrew or a subscriber desires to view the solution using a different flight path before executing that maneuver. A request may be sent with the new proposed flight plan and a new solution may be generated, in this illustrative example of a flight plan modification.

The illustration of dynamic environmental information transmission system 400 in FIG. 4 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

Figure 5:
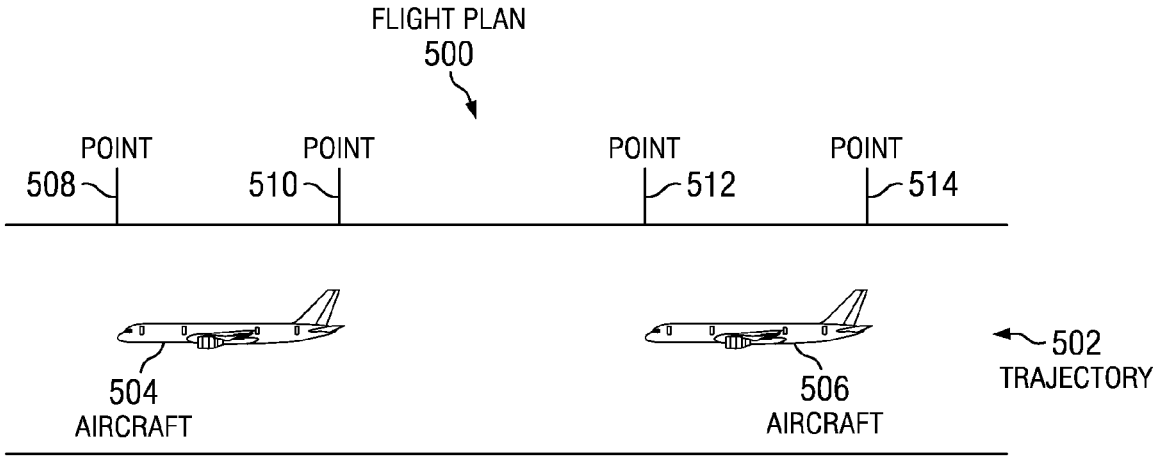
FIG. 5 is an illustration of a flight trajectory in accordance with an advantageous embodiment.

FIG. 5 is an illustration of a flight trajectory in accordance with an advantageous embodiment. Flight plan 500 may be an illustrative example of one implementation of a flight path sent through request 405 or push 407 in FIG. 4.

Flight plan 500 may include trajectory 502. Aircraft 504 may travel along trajectory 502 earlier in time than aircraft 506. During the time that aircraft 504 follows trajectory 502 of flight path 500, aircraft 504 may experience various weather factors at different points along trajectory 502, such as point 508, point 510, point 512, and point 514. Aircraft 504 and aircraft 506 may directly relay environmental information at each of points 508, 510, 512, and 514 to an operation center and/or aircraft environmental database, such as operation center 408 or aircraft environmental information 416 in FIG. 4, for example. Environmental information may include, for example, without limitation, temperature, atmospheric pressure, turbulence, wind speed, wind direction, altitude, the current and predicted phase of flight, and/or any other suitable information.

When aircraft 506 follows trajectory 502 along flight path 500 at a later time than aircraft 504, aircraft 506 may receive the benefit of the environmental information detected by aircraft 504 as well as the current environmental information detected by aircraft 506. The current environmental information detected by aircraft 506 may also be used to update the dated environmental information in the onboard computer of aircraft 506. The dated environmental information may be, for example, the environmental information detected earlier in time by aircraft 504, and/or environmental information uploaded preflight into the onboard computer of aircraft 506. In an illustrative example, aircraft 506 may request environmental information from a system, such as dynamic environmental information transmission system 400 in FIG. 4. The system can access the most recently acquired environmental information for trajectory 502 to determine the environmental information that is pertinent to aircraft 506. Additionally, the system can determine whether or not there is an economic benefit to aircraft 506 of an environmental information transmission. The information obtained by aircraft 504 along trajectory 502 may be used to anticipate the environmental factors aircraft 506 will encounter on points 508, 510, 512, and 514 of trajectory 502 for flight path 500. Additionally, current environmental information detected by aircraft 506 along trajectory 502 may also be used to update onboard environmental information and anticipate the environmental factors aircraft 506 will encounter on upcoming points 508 and 510 along trajectory 502.

Figure 6:
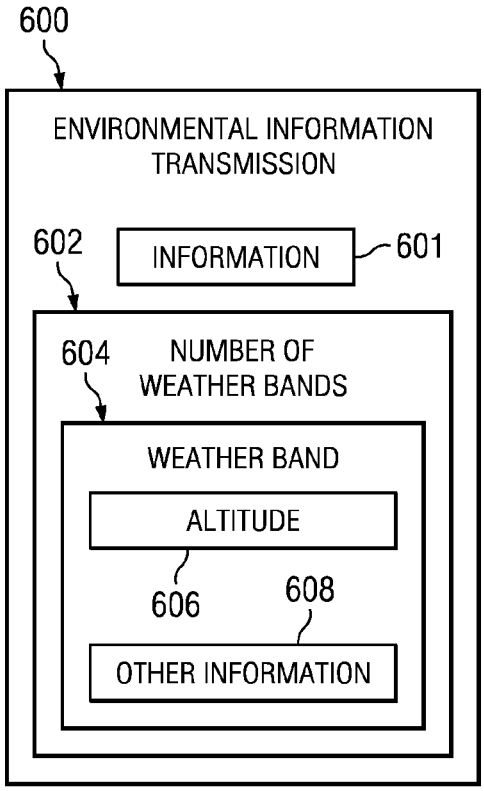
FIG. 6 is an illustration of an environmental information transmission in accordance with an advantageous embodiment.

FIG. 6 is an illustration of an environmental information transmission in accordance with an advantageous embodiment. Environmental information transmission 600 may be an example of environmental information transmission 452 in FIG. 4.

Environmental information transmission 600 may include information 601 and number of weather bands 602. Information 601 may be information, such as, without limitation, weather, temperature, pressure, humidity, turbulence, icing, wind speed, wind direction, wind vertical acceleration, thermal anti-icing for engine bleeds, temperature deviations from standard atmospheric temperatures, barometric pressure, and/or any other suitable environmental information. Number of weather bands 602 includes weather band 604. Weather band 604 includes information such as, without limitation, altitude 606 and other information 608. Other information may include, without limitation, temperature, atmospheric pressure, anti-ice levels, wind speed, wind direction, and/or any other suitable information specific to altitude 606.

The illustration of environmental information transmission 600 in FIG. 6 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some advantageous embodiments, number of weather bands 602 may include one or more weather bands in addition to weather band 604. In this example, each weather band may include weather information specific to the altitude of that weather band, just as other information 608 is specific to altitude 606 for weather band 604. As used herein, number refers to one or more weather bands.

Figure 7:
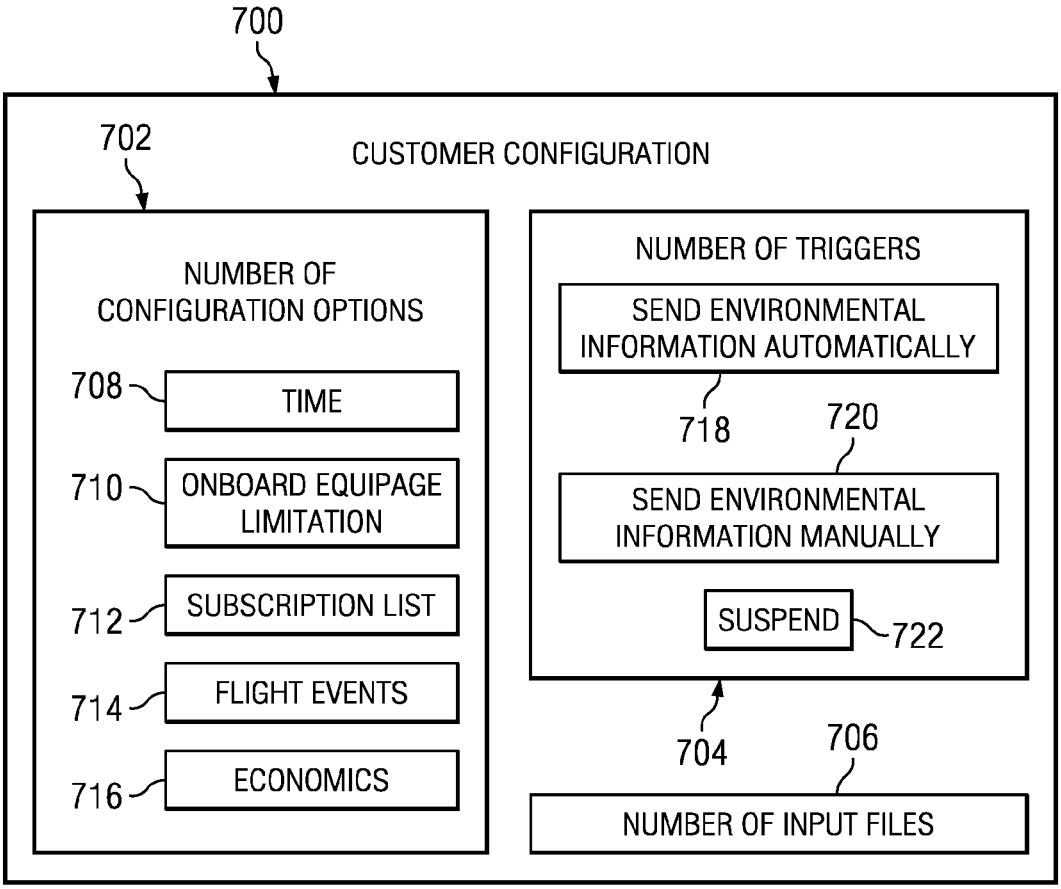
FIG. 7 is an illustration of a customer configuration in accordance with an advantageous embodiment.

FIG. 7 is an illustration of a customer configuration in accordance with an advantageous embodiment. Customer configuration 700 may be an illustrative embodiment of one implementation of customer configuration 462 and/or customer configuration 448 in FIG. 4.

Customer configuration 700 may include, without limitation, number of configuration options 702, number of triggers 704, number of input files 706, and/or any other suitable configuration options.

Number of configuration options 702 may include, for example, without limitation, time 708, onboard equipage limitation 710, subscription list 712, flight events 714, economics 716, and/or any other suitable configuration option.

Number of triggers 704 may include, for example, without limitation, send environmental information automatically 718, send environmental information manually 720, suspend 722, and/or any other suitable trigger. Suspend 722 may enable a temporary inhibition of a transmission to a subscriber.

Number of input files 706 may include, without limitation, flight plans, trajectories, configuration files, and/or any other suitable input file.

Figure 8:
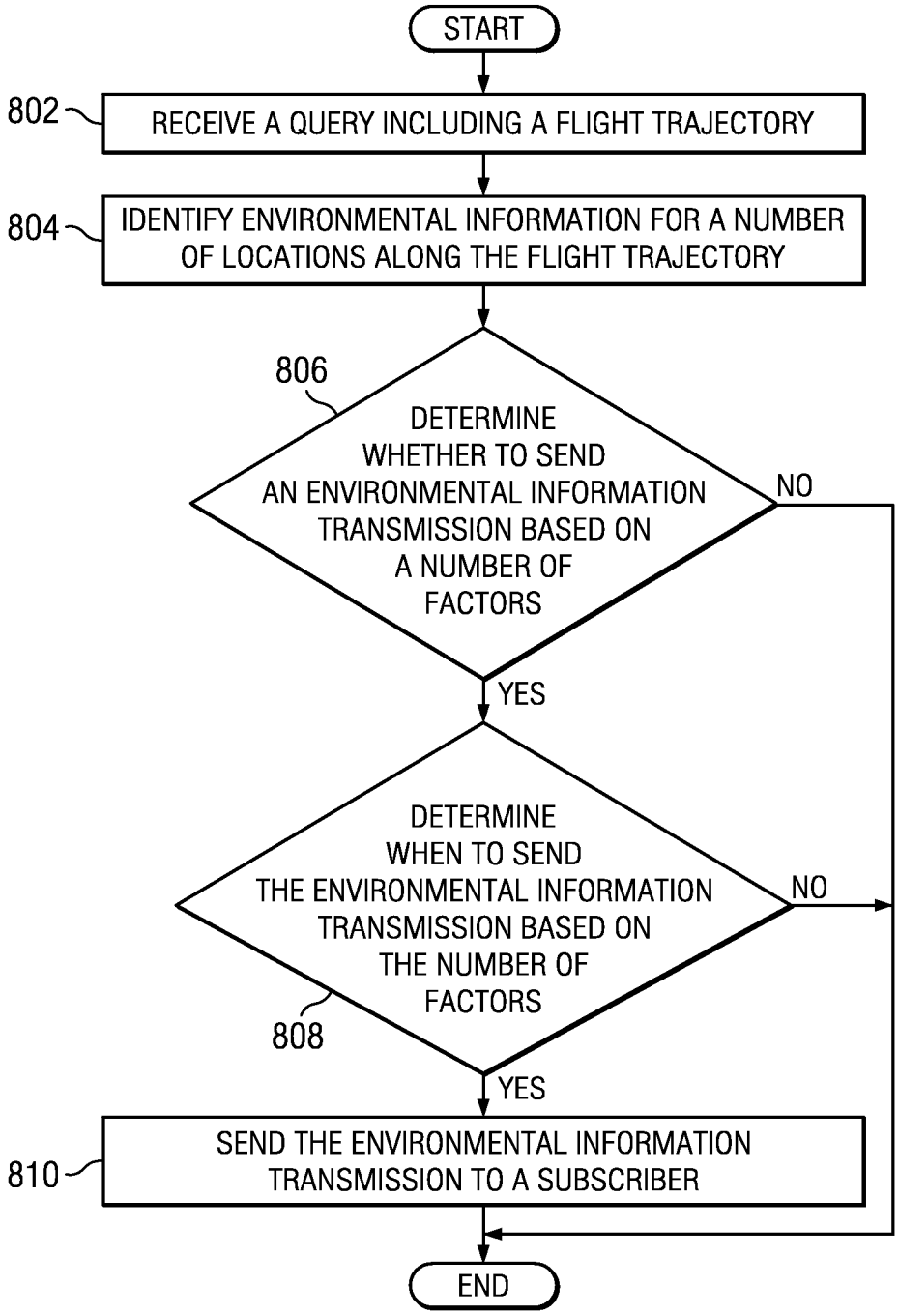
FIG. 8 is an illustration of a process for transmitting environmental information in accordance with an advantageous embodiment.

With reference now to FIG. 8, an illustration of a process for transmitting environmental information is depicted in accordance with an advantageous embodiment. The process in FIG. 8 may be implemented by a component such as dynamic transmission processor 402 in FIG. 4, for example.

The process begins by receiving a query including a flight trajectory (operation 802). The query may be received, for example, through a request, such as request 405 in FIG. 4, or an information push, such as push 407 in FIG. 4. The process identifies environmental information for a number of locations along the flight trajectory (operation 804). The process determines whether to send an environmental information transmission based on a number of factors (operation 806). The number of factors may include, for example, without limitation, the environmental information, valid subscriber list, time, onboard equipage limitations, system latency, flight events, flight deck limitations, manual synchronization, economics, customer configuration, and/or any other suitable factor.

If the process determines that the environmental information transmission may not be sent based on the number of factors, the process terminates. As an illustrative example, the process may determine that the query received is not from a valid subscriber, identified using a valid subscription list, such as valid subscription list 432 in FIG. 4. If the query is not from a valid subscriber, in this example, an environmental information transmission may not be sent, and the process does not proceed to a determination as to the economic benefit of such a transmission.

If the process determines that the environmental information transmission may be sent, the process then determines when to send the environmental information transmission based on the number of factors (operation 808). The determination as to when to send the environmental information transmission may be made using an economic benefit factor, for example. In another illustrative example, the determination as to when to send the environmental information transmission may be made according to a number of factors, such as time or flight events for example. If a determination is made as to when to send the environmental information transmission, the process sends the environmental information transmission to a subscriber (operation 810), with the process terminating thereafter. If a determination is made not to send the environmental information transmission, the process does not send the transmission and the process terminates.

The subscriber may be, for example, without limitation, an aircraft, an operation system, a ground system, and/or any other suitable subscriber. The process illustrated in FIG. 8 is not meant to imply physical or architectural limitations to the manner in which different advantageous embodiments may be implemented. Other operations in addition to and/or in place of the ones illustrated may be used. Some operations may be unnecessary in some advantageous embodiments. Also, the operations are presented to illustrate some functional steps. One or more of these operations may be combined and/or divided into different operations when implemented in different advantageous embodiments.

For example, operation 808 may occur simultaneously to that of operation 806, with the process concurrently determining whether and when to send an environmental information transmission.

The flowcharts and block diagrams in the different depicted embodiments illustrate the architecture, functionality, and operation of some possible implementations of apparatus and methods in different advantageous embodiments. In this regard, each block in the flowchart or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

The different advantageous embodiments can take the form of an entirely hardware embodiment, an entirely software embodiment, or an embodiment containing both hardware and software elements. Some embodiments are implemented in software, which includes but is not limited to forms, such as, for example, firmware, resident software, and microcode. Furthermore, the different embodiments can take the form of a computer program product accessible from a computer-usable or computer-readable medium providing program code for use by or in connection with a computer or any device or system that executes instructions. For the purposes of this disclosure, a computer-usable or computer readable medium can generally be any tangible apparatus that can contain, store, communicate, propagate, or transport the program for use by or in connection with the instruction execution system, apparatus, or device. The computer usable or computer readable medium can be, for example, without limitation an electronic, magnetic, optical, electromagnetic, infrared, or semiconductor system, or a propagation medium. Non limiting examples of a computer-readable medium include a semiconductor or solid state memory, magnetic tape, a removable computer diskette, a random access memory (RAM), a read-only memory (ROM), a rigid magnetic disk, and an optical disk. Optical disks may include compact disk-read only memory (CD-ROM), compact disk-read/write (CD-R/W) and DVD.

Further, a computer-usable or computer-readable medium may contain or store a computer readable or usable program code such that when the computer readable or usable program code is executed on a computer, the execution of this computer readable or usable program code causes the computer to transmit another computer readable or usable program code over a communications link. This communications link may use a medium that is, for example without limitation, physical or wireless.

A data processing system suitable for storing and/or executing computer readable or computer usable program code will include one or more processors coupled directly or indirectly to memory elements through a communications fabric, such as a system bus. The memory elements may include local memory employed during actual execution of the program code, bulk storage, and cache memories which provide temporary storage of at least some computer readable or computer usable program code to reduce the number of times code may be retrieved from bulk storage during execution of the code.

Input/output or I/O devices can be coupled to the system either directly or through intervening I/O controllers. These devices may include, for example, without limitation to keyboards, touch screen displays, and pointing devices. Different communications adapters may also be coupled to the system to enable the data processing system to become coupled to other data processing systems or remote printers or storage devices through intervening private or public networks. Non-limiting examples of modems and network adapters are just a few of the currently available types of communications adapters.

The different advantageous embodiments recognize and take into account a number of different considerations. For example, the different advantageous embodiments recognize and take into account that currently used systems do not have the ability to automatically measure the added benefit of a possible environmental information transmission. Even when environmental information is transmitted, current methods increase inefficiencies in the flight trajectory calculations if the environmental information is out of date, not entered into a flight management computer, or provided at the wrong time. Additionally, current systems and methods do not consider the impact of environmental factors, flight phases, the type of environmental information, or aircraft events when choosing whether or not to send an environmental information transmission. Rather, current methods require a manual uplink and typically a manual request for an environmental information transmission.

The different advantageous embodiments further recognize and take into account the need for a comprehensive environmental information transmission process that can measure economic benefit to automatically determine the needed transmission time to accommodate the dynamic nature of aircraft flight. Economic benefit to aircraft operations can be measured in time saved, fuel saved, a reduction in noise, a reduction in emissions, and/or any combination of the foregoing.

Thus, the different advantageous embodiments provide a system comprising a dynamic transmission process and a processor unit. The processor unit is configured to run the dynamic transmission process. The dynamic transmission process is configured to receive environmental information. The dynamic transmission process determines whether to send the environmental information to a subscriber.

The different advantageous embodiments further provide a method for transmitting environmental information. Environmental information is identified for a number of locations along a flight trajectory using a processor unit. A determination is made as to whether to send an environmental information transmission based on a number of factors using the processor unit.

The different advantageous embodiments further provide a method for generating an environmental information transmission. A recipient is identified for the environmental information transmission using a processor unit. The environmental information transmission is formatted based on the recipient identified using the processor unit.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A system comprising:

a dynamic transmission process configured to receive environmental information, wherein the environmental information is specific to a particular current or predicted flight trajectory of an aircraft; and a processor unit configured to run the dynamic transmission process, wherein the dynamic transmission process determines whether to send the environmental information to a subscriber, wherein the dynamic transmission process sends the environmental information to the subscriber if an economic benefit results from a prospective transmission.

2. The system of claim 1, wherein the dynamic transmission process detects an event that initiates a determination of when to send the environmental information to the subscriber.

3. The system of claim 1, wherein the subscriber is at least one of an aircraft, an operation center, and a ground system.

4. The system of claim 1, wherein the dynamic transmission process further comprises a number of factors used to determine when to send the environmental information to the subscriber.

5. The system of claim 4, wherein the number of factors include at least one of valid subscriber list, time, onboard equipage limitations, system latency, flight events, flight deck limitations, manual synchronization, economic benefit, and customer configuration.

6. The system of claim 1, wherein the economic benefit is selected from time saved, fuel saved, a reduction in noise, a reduction in emissions, a reduction in crew workload, and a reduction in operator workload.

7. A system comprising:

a dynamic transmission process configured to receive environmental information, wherein the environmental information is specific to a particular current or predicted flight trajectory of an aircraft; and a processor unit configured to run the dynamic transmission process, wherein the dynamic transmission process determines whether to send the environmental information to a subscriber, wherein the dynamic transmission process sends the environmental information to the subscriber if a request or manual trigger overrides an automatic transmission.

8. A system comprising:

a dynamic transmission process configured to receive environmental information, wherein the environmental information is specific to a particular current or predicted flight trajectory of an aircraft; and a processor unit configured to run the dynamic transmission process, wherein the dynamic transmission process determines whether to send the environmental information to a subscriber, wherein the dynamic transmission process inhibits the transmission of the environmental information to the subscriber if a request or manual trigger overrides an automatic transmission.

9. A method for transmitting environmental information, the method comprising:

identifying the environmental information for a number of locations along a flight trajectory using a processor unit, wherein the environmental information is specific to a particular current or predicted flight trajectory of an aircraft;

determining whether to send an environmental information transmission based on a number of factors using the processor unit; and responsive to a determination that there is an economic benefit to the environmental information transmission, sending the environmental information transmission to a subscriber.

10. The method of claim 9, further comprising:

determining when to send the environmental information transmission based on the number of factors.

11. The method of claim 9, wherein the environmental information is obtained directly from an aircraft on the flight trajectory.

12. The method of claim 9, wherein the environmental information is obtained from a number of weather sources.

13. The method of claim 9, wherein the number of factors include at least one of environmental information, valid subscriber list, time, onboard equipage limitations, system latency, flight events, flight deck limitations, manual synchronization, economics, and customer configuration.

14. The method of claim 9, wherein the subscriber is selected from a group including at least one of an aircraft, an operation system, and a ground system.

15. A method for generating an environmental information transmission, the method comprising:

identifying a recipient for the environmental information transmission using a processor unit, wherein the environmental information is specific to a particular current or predicted flight trajectory of an aircraft;

formatting the environmental information transmission based on the recipient identified using the processor unit;

identifying a number of data formats capable of being received by the recipient; and formatting the environmental information transmission based on the number of data formats identified.

16. The method of claim 15, further comprising:

identifying a number of factors associated with the recipient using a dynamic transmission process; and generating the environmental information transmission using the number of factors to determine content for the environmental information transmission.

17. The method of claim 15, wherein the recipient is at least one of an aircraft, an operation center, and a ground station.

18. A system comprising:

a dynamic transmission process configured to receive environmental information, wherein the environmental information is specific to a particular current or predicted flight trajectory of an aircraft; and a processor unit configured to run the dynamic transmission process, wherein the dynamic transmission process determines whether to send the environmental information to a subscriber, wherein the dynamic transmission process inhibits the transmission of the environmental information to the subscriber if an economic benefit does not result from a prospective transmission.

19. The system of claim 18, wherein the dynamic transmission process detects an event that initiates a determination of when to send the environmental information to the subscriber.

20. The system of claim 18, wherein the system is located in a remote location from the subscriber and the subscriber is at least one of an aircraft, an operation center, and a ground system.

21. The system of claim 18, wherein the dynamic transmission process further comprises a number of factors used to determine when to send the environmental information to the subscriber.

22. The system of claim 21, wherein the number of factors include at least one of valid subscriber list, time, onboard equipage limitations, system latency, flight events, flight deck limitations, manual synchronization, economic benefit, and customer configuration.

23. The system of claim 18, wherein the environmental information is weather information.

* * * * *